United States Patent [19]

Vall

[11] 4,129,080

[45] Dec. 12, 1978

[54] SHELF SUPPORT DEVICE

[76] Inventor: Seymour Vall, 35 W. 81 St., New York, N.Y. 10024

[21] Appl. No.: 781,550

[22] Filed: Mar. 28, 1977

[51] Int. Cl.[2] ..... A47B 5/00

[52] U.S. Cl. ..... 108/149

[58] Field of Search ..... 248/328, 342, 343, 317; 211/113, 118, 117; 108/152, 149; 108/152, 149; 312/3, 6

[56] References Cited

U.S. PATENT DOCUMENTS

| | | | |
|---|---|---|---|
| 1,075,478 | 10/1913 | Johnson | 312/6 |
| 1,227,723 | 5/1917 | Wilson | 108/149 X |
| 1,816,705 | 7/1931 | Traylor et al. | 108/149 X |
| 2,205,193 | 6/1940 | Goldman | 108/152 X |
| 2,244,887 | 6/1941 | Manley | 312/6 |
| 2,440,192 | 4/1948 | Cowan | 312/6 |
| 2,556,105 | 6/1951 | Rhett | 108/149 X |
| 3,340,829 | 9/1967 | Palmer | 108/149 |
| 3,585,944 | 6/1971 | Scheer | 108/152 X |
| 3,901,165 | 8/1975 | Schlesinger | 108/149 |
| 3,901,165 | 8/1975 | Schlesinger | 248/328 X |
| 4,061,092 | 12/1977 | Jacobsen et al. | 108/149 |

FOREIGN PATENT DOCUMENTS

| | | | |
|---|---|---|---|
| 608482 | 7/1926 | France | 108/149 |
| 1072659 | 3/1954 | France | 108/149 |
| 1075041 | 11/1955 | France | 312/3 |
| 195717 | 4/1923 | United Kingdom | 108/149 |

*Primary Examiner*—James T. McCall

[57] ABSTRACT

A shelf support device is disclosed which can be wall hung, ceiling hung or free standing. The device is constructed from non-rigid support materials including shelf slings, hangers, sling locks, keepers, loops and sling lock-keepers. In preferred embodiments the device can be constructed in a "Delta" or in a "X Frame" configuration.

7 Claims, 7 Drawing Figures

SHELF SUPPORT DEVICE

DESCRIPTION OF THE INVENTION

The present invention relates to a novel shelf support device which is adaptable to be wall hung, ceiling hung or to be free-standing. The subject device is constructed from non-rigid support materials which become rigid when stressed.

A feature of the subject device is the use of shelf sling means which when hung in accordance with the present disclosure convert the "outward" moment of each loaded shelf to a vertical stress down the surface of the wall directly beneath and at right angles to the point at which the device is anchored into the wall. Unlike rigid wall hung units, the weight of the loaded shelves cannot lever the anchor out of the wall. In addition, the completely vertical stress transfer function, designed into the unit takes advantage of the strongest load bearing surface offerred by any given wall.

Advantages of the present device over shelf systems previously known in the art include ease of installation in that the instant device does not require precise measurements or alignment when fastening to the wall, it offers virtually infinite choice of shelf positioning since there are no slots or holes to limit choice, it is light and compact and thus can be stored or shipped in small, convenient packages and finally the material costs are substantially lower than the costs associated with the prior art systems.

While the configuration in which the device of the present invention is constructed is not narrowly critical, it is preferred to employ either a "Delta" or "X Frame" configuration. Both configurations employ the same set of materials and parts but in different order and arrangement as will become apparent from the further discussion which follows below.

The Delta configuration may only be used as a wall hung unit. The supporting units have a triangular arrangement when viewed from the end of the shelf unit and an inverted "step" arrangement when seen from the front.

The X Frame configuration may be hung from a wall, ceiling or from a free standing frame. When viewed from the end, the supporting units are seen to be in an X arrangement.

The device of the invention utilizes a strap means as the main shelf support members. Generally, two strap means are employed in any single unit installation. Dimensions of the strap means are not narrowly critical. Convenient dimensions include a length of about 20 feet and a width of about 1½ inches. Such dimensions are sufficient to hang eight 48 inch by 10 inch by ¾ inch shelves on a wall 8 feet high.

The strap means can be derived from flexible materials of reasonably high tensile strength. Suitable materials include plastic extrudates, plastic woven belts, plastic-paper laminates, leather, plastic-metal foil laminates and the like. A particularly preferred material is a plastic woven belt, most preferably a polypropylene web. The polypropylene strap means has a breaking strength of more than 700 lbs. and thus a unit containing two such strap means can hold up to about 1400 lbs.

When installed according to the present invention, the aforesaid strap means will fall in two strands. In the Delta configuration the inner strand will be against the wall and for the purpose of this disclosure will be referred to as the "wallstrap". The outer strand will be referred to as the "sling". Both the inner and outer strands in the X Frame configuration will be referred to as the "sling".

The wallstrap functions as the supporting column for the Delta configuration embodiment. It collects the total outward moment of each loaded shelf and converts it to a vertical stress. Thus, assuming that the bolts used to anchor the device are of sufficient strength, the bolts would have to shear vertically through the wall before they could be pulled from the wall.

Components used in construction of the shelf support device besides the strap means discussed above include (a) hanger means, (b) sling lock means, (c) keeper means, (d) loop means and (e) stabilizing sling lock means. The last named component (e) is a combination of component (b) and either component (c) or component (d) as will be discussed in greater detail below.

In a preferred embodiment the hanger means is a steel plate having dimensions of approximately 7 in. × 2 in. × 3/32 in. A slot measuring 1½ in. by ¼ in. is punched out ¼ in. from one longitudinal end. The other end of the plate is rounded to prevent cutting into the strap means. Three 7/32 in. diameter holes are drilled on alternate sides of the longitudinal center line of the plate, located 1 in., 3½ in. and 6 in. from the unslotted end of the plate respectively. The three holes are utilized to allow supporting bolts to be inserted into the support, i.e., wall, ceiling or free standing support. However, prior to completely tightening these bolts the strap means is inserted and positioned in the slot. Tightening of the anchor bolts locks the strap means in position.

The second of the aforesaid components is a sling lock means which in a preferred embodiment consists of an adjustable, self locking buckle device which is designed and constructed to lock two strands of the strap means in place regardless of the direction of strain on either or both strands. It is further designed and constructed to permit easy adjustment of both strands simultaneously in either direction or to lock the inner strand in place while adjusting the outer strand in either direction.

The operative mechanism of the sling lock means consists of two parts: the buckle and the lock bar. The buckle is made of steel and can conveniently be constructed, in a preferred embodiment, to have dimensions of 1¾ in. × 1⅞ in. × 3/32 in. Two slots, divided by a center bar, are punched out parallel to the longitudinal axis of the buckle. Each of the slots measure 1½ in. × ¼ in.

The lock bar is a metallic piece which in the preferred embodiment measures initially 1 5/16 in. × ½ in. × 3/32 in. A notch 5/16 in. deep is centered on each end of the bar and the corners are rounded to remove sharp edges. The notched ends of the bar are bent at the point where the notches end at right angles to the center portion of the bar so that the bar has a short armed U shape.

The sling lock is assembled by placing the lock bar on the center bar of the buckle so that the arms of the lock bar straddle the center bar of the buckle. The lock bar is then swiveled in either direction until it is at right angles.

During use in the shelf support device, the sling lock is held so that the lock bar is in the lower half of the buckle. The two strands comprising the strap means are fed simultaneously through the support slot of the buckle, back to front, over the lock bar, and then between the lock bar and the lower portion of the buckle. Under tension the solid portion of the lock bar swivels to firmly hold the two strands against lower bar of the buckle regardless of the direction of strain.

Pushing the strands into the sling lock relieves the tension and allows for easy adjustment of both strands at the same time. If desired, however, tension may be maintained on the inner strand while tension on the outer strand is released. The outer strand may therefore be adjusted while the inner strand remains locked in position.

Keeper means which comprise the third component are designed to stabilize the shelf support device by preventing the shelves from moving horizontally or moving out and away from the wall. They also serve to isolate and localize the strain on any single shelf making it independent of the other shelves in the device. In the Delta configuration, the installation of keeper means will prevent shelves from tipping up or down under sudden changes of load.

Figure 1:
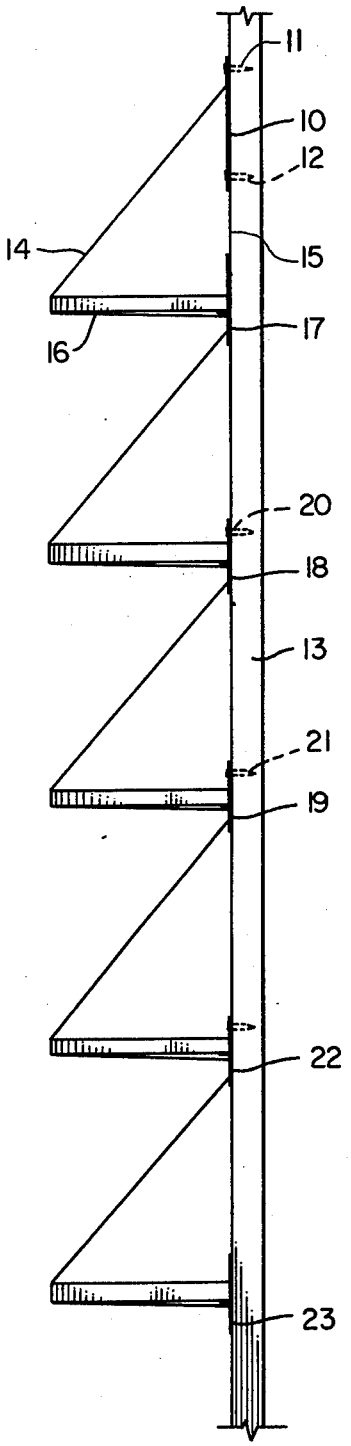
FIG. 1 is a schematic end view of the shelf support device in the Delta configuration.

In a preferred embodiment, the keeper means consist of a $1\frac{1}{4}$ in. steel disk or square with a hole in the center adapted to accept a #7 or #8 screw. They are intended to be placed most desirably over the wallstrap at a point above each shelf or alternatively immediately below the sling lock and anchored to the wall. It should be noted that after keeper means have been installed it is necessary to remove them before making any major alterations in the structural arrangement of the device. Should any shelf become overloaded to the point the keeper means is pulled from the wall, the device is so designed and constructed to transfer the load of the shelf to the wallstrap where the stress can be safely absorbed.

Loop means are the fourth device component. They are designed to stabilize the shelf support device without isolating each shelf in the unit. When the loop means are used in the Delta configuration the shelves will not move horizontally across the wall or swing out and away from the wall. However, in such case the full weight of the device will be carried by the wallstrap and will be borne by the hanger means at the point of original attachment.

In a preferred embodiment said loop means consists of a steel plate which can have dimensions of 2 in. $\times$ $\frac{1}{2}$ in. $\times$ 3/32 in. A countersunk hole for a #7 screw is located at each end. The loop means is intended to be installed just above each shelf. It is placed over the wellstrap and anchored to the wall using the holes at both ends. A washer may be used as a spacer so that the wallstrap is permitted to slide between the loop means and the wall. Should major adjustments be made to the device, the loop means may be left in place while additional loop means may be added as required.

Finally, the fifth component is the sling lock-keeper means. This component is also designed to lock the strands in position while providing easy adjustment and stabilization of the entire device while eliminating the need of using keeper means.

The sling lock-keeper means, in a preferred embodiment, consists of three separate parts: (i) sling lock plate, (ii) buckle and (iii) lock bar. The sling lock plate consists of a steel plate measuirng 4 in. $\times$ 2 in. $\times$ 3/32 in. Slots, $1\frac{1}{2}$ in. $\times$ $\frac{1}{4}$ in. each are punched across each end of the plate. These slots are located 5/16 in. from the ends of the plate. A third slot of the same dimensions as the others is punched across the center portion of the plate. The waste material from this slot is bent at right angles to the plate to form a support for the shelf.

The buckle is the same design as described above in the discussion of the sling lock means.

The lock bar also is of the same dimensions as the lock bar described for the sling lock means with the exception however, that the arms are not bent. When assembled, the arms of the lock bar will ride on the sides of the buckle between the upper bar and center bar of the buckle.

In use the plate is held so that the shelf rest is higher than the center slot. The wallstrap is fed into the upper slot front to back and then through the center slot to the front of the plate. The wallstrap is then passed through one end of the buckle, backthrough the center slot, behind the plate and through the lower slot. The lock bar is inserted in the unoccupied portion of the buckle. The other strand, i.e., the sling is then passed, bottom to top, between the outer bar of the buckle over the lock bar and down between the lock bar and the center bar of the buckle.

The sling lock keeper is designed to attach the sling to the wallstrap at the junction of the brace and the shoulder. As used in the present disclosure the terms "brace" and "shoulder" are defined as follows. When supporting a shelf, each section of sling has two distinct parts. The portion of the sling upon which the shelf rests is the shoulder. The diagonal portion is called the brace.

When installed in a shelf support device having a Delta configuration, the sling lock keeper means will overcome the following causes of instability.

An "unstabilized" installation of a Delta configuration device can be detected by observing the following conditions:

I. If all shelves carry equal weight, shelves 1, 2 and 3 (numbered top to bottom) will be stable;

II. If shelf #1 is lightened, its outer edge will tilt up while shelf #2 will tilt down and shelf #3 will remain stable;

III. If shelf #2 is lightened, shelf #1 will remain stable, shelf #2 will tilt up and shelf #3 will tilt down; and, IV. If shelf #3 is lightened shelves #1, #2 and #3 all will remain stable.

Thus, a lighter shelf will permit a heavier shelf below it to tilt downward, while the lighter shelf tilts upward. The tilting occurs when the wallstrap is pulled away from the wall by the tilting moment of the lower shelf. This stress is focused at the junction of the wallstrap shoulder and brace just above the heavier shelf.

The tipping of the shelves is limited by the tension on the wallstrap. In theory, enough tension would limit tipping entirely. In practice, however, sufficient tension on the wallstrap to overcome the problem could easily triple or quadruple the strain on the wallstrap and the load on the hanger.

The sling lock-keeper means overcomes the problem in several ways. In the first place it acts to increase the tension of the wallstrap at the exact point at which the wallstrap and sling are joined, by functioning as a "bow" in all points where the wallstrap would be pulled away from the wall. Moreover this component actually increases the tension of the wallstrap as it moves away from the wall resisting any effort to move it. Additionally, the lower half of the component also forms a shelf bracket for the heavier shelf. It forms a second bracket immediately above the lighter shelf and resists the upward tilt of the lighter shelf.

Under normal conditions tilting will be eliminated while the shelf load will cause the shelves to rest against the wall in a stable horizontal condition. Where extreme differences in shelf loading will be a constant condition, the device may be anchored to the wall.

Turning first to FIG. 1, hanger 10 is attached to wall 13 by anchor means 11 and 12. Suitable anchor means include toggle bolts or molly bolts. Other anchor means known in the art may be employed depending on the nature and composition of said wall. The hanger 10 supports two strap means or strands 14 and 15. The strand 14 which supports the shelves directly in the Delta configuration is termed the sling, with the diagonal portion called the brace and the portion 16 directly supporting the shelf called the shoulder. The second strand is called the wallstrap 15 and runs vertically along the wall. Sling locks 17, 18 and 19 are situated below each shelf and support the slings at such points. Keepers or loops may be positioned above the shelves such as at 20 and 21 as needed. Alternatively, it is possible to use a sling lock-keeper such as at 22 and 23 instead of keepers or loops and sling locks.

Figure 2:
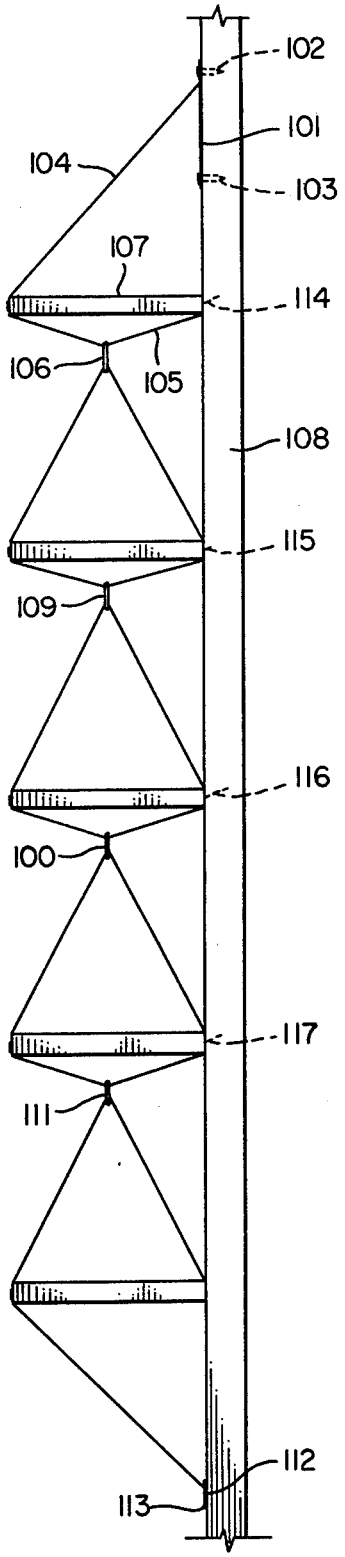
FIG. 2 is a schematic end view of the shelf support device in the X frame configuration.

In FIG. 2, a representative embodiment of the X Frame configuration is shown. As before hanger 101 is attached to the wall 108 by suitable anchor means 102 and 103. The hanger supports strap means 104 and 105 which in this configuration are both called slings. Shelf 107 is supported by the slings which are joined by sling lock 106. This arrangement is repeated for each shelf in unit using sling locks 109, 110 and 111. Further support can be derived by inserting estucheon pins 114, 115, 116 and 117 in the side of the shelves joining the wall. The slings are then joined and tension retained by use of a sling lock 112 and keeper 113.

It should be noted that in respect to each of the aforesaid Figures only one side of the device is depicted. An identical arrangement is of course present on the other side of the device and all components set forth above are duplicated. Additionally, while five shelves are shown in each Figure, this should be considered illustrative only. The number of shelves is variable and depends on both the length of the strap means used and the dimensions of the shelves.

Figure 3:
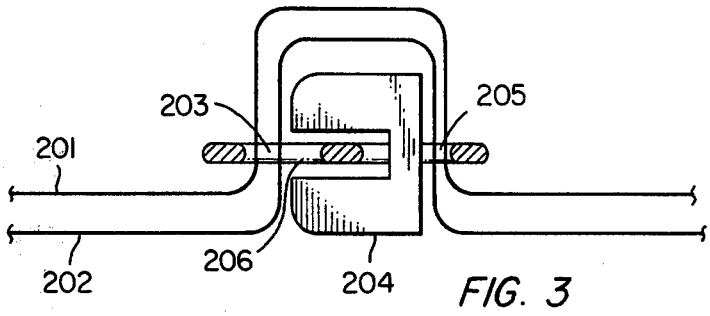
FIG. 3 is a diagrammatic view of the construction of the sling lock.

FIG. 3 shows the manner in which sling 201 and wallstrap 202 are passed through a sling lock which consists of buckle 206 and sling lock bar 204. The sling and wallstrap are passed through slot 203 on the upper buckle bar from front to back as shown by the arrows. The strands are passed behind lock bar 204 and then through slot 205 in the lower buckle bar and then down the device. Tension on the strands on top of the lock bar causes the lock bar to swivel thus closing the space between the lock bar and the lower buckle bar thereby locking the strands in place.

Figure 4:
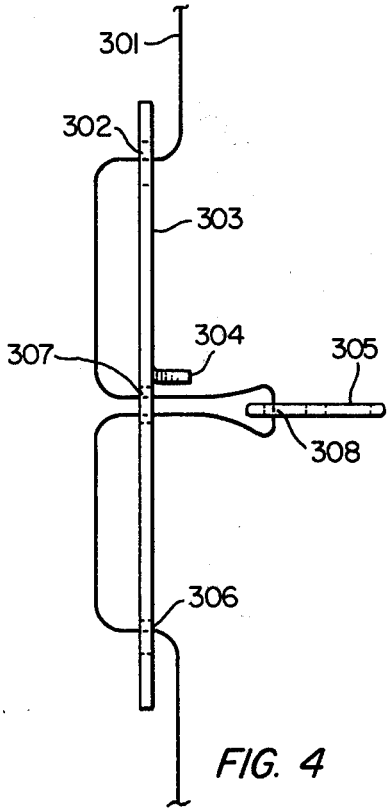
FIG. 4 is a similar view showing the construction of the sling lock-keeper.
Figure 3A:
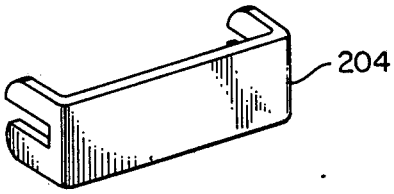
FIG. 3A is a perspective view of one of the lock bars.
Figure 5A:
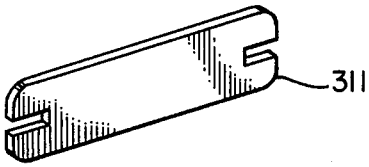
FIG. 5A is a perspective view of a second back bar.

In FIG. 4 the path of a wallstrap through the plate and buckle of a sling lock-keeper is shown. Thus, wallstrap 301 is passed through slot 302 at the top of plate 303 from front to rear. The wallstrap is then passed out through center slot 307 beneath shelf rest 304 and through slot 308 of buckle 305. It is then led back through slot 307 and then down behind plate 303 where it again is brought to the front through bottom slot 306.

Figure 5:
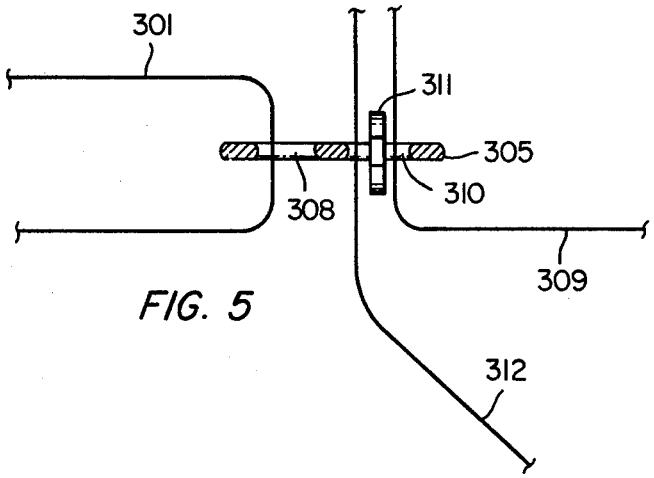
FIG. 5 describes the path of the sling through the sling lock-keeper buckles.

The remaining steps in the operation of the sling lock-keepers are shown in FIG. 5.

Wallstrap 301 is passed through buckle 305 via slot 308. The shoulder portion of sling 309 is passed through the second slot 310 in buckle 310, over lock bar 311 and then down and out to form the brace portion 312 of the sling.

The support device's installation can be carried out as follows.

1. Position hangers 32 inches apart for 48 inches shelves and 24 inches apart for 36 inch shelves, measure inside edge to inside edge. (Distance between hangers are optimum, but not critical.)

For shelves longer than 48 inches add one additional hanger for each 48 inches.

Shelves may be of any width and different widths may be intermingled.

If top shelf is to rest less than 13 inches from ceiling, mount hanger with slot at top, otherwise mount as desired.

2. Position hangers at any height desired. Mark and drill, 7/32 bolts are suggested. Make sure they are long enough so that the toggle or expanding portion can catch behind plaster in hollow walls.
3. Attach hangers to the wall. Do not tighten.
4. Insert straps through slot in hanger. Adjust straps until strand closest to wall just touches floor. Tighten hanger bolts. (Outer strand is the sling. Inner strand is the wallstrap.)
5. Assemble sling locks by placing legs of lock bar so that they straddle center bar of buckle. Swivel lock bar until it is at right angles to buckle.
6. Hold buckle with lock bar at lower end. Insert both ends of strap as one, back to front, through top section of buckle, over lock bar and between lock bar and lower portion of buckle. The wall strap should be the inner strand, the sling, the outer strand.
7. Mark wall for approximate position of top shelf. (Do not mark straps.) Run sling lock up wall strap to mark. Remove all slack in sling.
8. Insert top shelf between two pairs of straps so that shelf is flat against wall. Adjust one sling lock for rough level of shelf edge.
9. Slack off on slings until shelf is roughly level, front to back, with shelf resting on top of buckle and buckle flat against the wall.
10. Repeat until all shelves are hanging. Do not attempt to fine tune. Caution: Distance between shelves should not be less than the width of the lower shelf.
11. Stand back and inspect result. Are shelves at correct height? Are shelves far enough apart to accommodate height of load.

Note: Unstabilized shelves may tip if loaded unevenly. Test load with care.

Final Installation

12. Remove all but top shelf. Fine level. Load shelf with as many books that will fit between slings. Check level. Make sure shelf rests on top of buckle and buckle is flat against wall.

13. If shelf slightly out of level end to end, add or remove weight to balance.
14. Check to see that portion of wall strap above shelf is straight. Using common nail, pierce wall strap at center, ½ inch above shelf. Tap with hammer to make clear mark in wall. Leave nail in strap to mark point of entry.
15. Remove books and shelf. Drill hole at marks for plaster wall anchors. (1 inch plastic plug to accept 1¼inches #8 pan head, self tapping screw, recommended.) Use 3/16 masonry bit.
16. Place keeper on screw. Remove nail and gently replace with screw. Stretch wall strap until screw can be inserted into anchor plug level and fasten screw.
17. Replace shelf, load, check level and adjust if necessary.
18. Repeat procedure for each shelf, top to bottom. Once shelf has been stabilized, simply move load to next lower shelf.
19. Trim, roll and pin, or fasten remainder of strap to wall. If trimmed, seal raw edge by heating gently with match or soldering iron.

Instructions — X Frame System

1. Attach hanger to wall. Follow instructions for Delta system. However, both inner and outer strand should be of same length.
2. Add one sling lock for each shelf and run up to approximate height.
3. Insert shelves and level.
4. Check entire unit and adjust as necessary.
5. Load top shelf, level and use escutcheon pin or screw and countersunk washer to fasten strap to edges of shelf.
6. Adjust buckles so that each shelf is against the wall.
7. Fasten remaining portion of strp to wall or baseboard under tension. Keepers may be used if desired.

The X Frame system may also be hung from a ceiling or slung from a free standing frame. Be certain that ceiling or frame will carry the load. If using hanger on ceiling fasten strap between hanger and ceiling along length of hanger.

The X frame system should always be in balance, regardless of the load differential on other shelves. It is designed to be used without stabilizing devices. However it is recommended that the ends of the strap be fastened to the floor under tension.

I claim:

1. A shelf support device comprising in combination a plurality of components including:

A. a plurality of strap means each arranged in two strands and providing direct support for a plurality of shelves;

B. hanger means anchored to a vertically extending support, said hanger means supporting a first end of each of said strands of said strap means;

C. sling lock means located at spaced intervals along said strands, said sling lock means locking said strands in place to provide support for each said shelves; and, D. sling lock keeper means so arranged and constructed to anchor the second end of each said strap means to said support; whereby the non-rigid materials comprising said shelf support device are so arranged and constructed to become rigid when stressed.

2. The shelf support device of claim 1 wherein said support is a wall, said device is in a delta configuration, a first said strand is supported vertically proximate to said wall and a second said strand forms a sling with shoulder portions and brace portions, said shoulder portions each supporting a shelf and said brace and shoulder portions being attached to said wallstrap through said sling lock means.

3. The device of claim 2 wherein additional support and stability is obtained by anchoring said wallstrap to said support using at least one pair of keeper means or loop means at a point above one or more of said shelves.

4. The shelf support device of claim 1 wherein said strands are each designated slings which are attached to each other at spaced intervals along their lengths by said sling lock means so as to support a shelf above each such attachment, said device thereby being in the X-configuration.

5. The shelf support device of claim 1 wherein said sling lock means is an adjustable, self locking buckle device consisting of a buckle having two slots divided by a center bar and a lock bar adapted to straddle said center bar whereby said strands are passed through said buckle and held in place under tension by said lock bar when strain is applied to said strands.

6. The shelf support device of claim 1 wherein said sling lock-keeper means consists of the following in combination:

A. a sling lock plate having three slots punched across the width thereof, the waste material from said central slot being bent at right angles to form a shelf rest;

B. a buckle having two slots divided by a center bar; and,

C. a lock bar adapted to ride on the sides of said buckle between the center bar and the upper bar.

7. The device of claim 1 in kit form.

* * * * *